US006861804B2

(12) United States Patent
Liu et al.

(10) Patent No.: US 6,861,804 B2
(45) Date of Patent: Mar. 1, 2005

(54) COLD CATHODE FLUORESCENT FLAT LAMP

(75) Inventors: Wen-Tsang Liu, Hsinchu (TW); Chih-Fang Chen, Hsinchu (TW); Lai-Cheng Chen, Hsinchu (TW); Ruey-Feng Jean, Hsinchu (TW); Jung-Jong Wang, Hsinchu (TW)

(73) Assignee: Optoelectronics, Inc., Hsinchu (TW)

( * ) Notice: Subject to any disclaimer, the term of this patent is extended or adjusted under 35 U.S.C. 154(b) by 202 days.

(21) Appl. No.: 09/923,877

(22) Filed: Aug. 6, 2001

(65) Prior Publication Data

US 2002/0140344 A1 Oct. 3, 2002

(30) Foreign Application Priority Data

Mar. 27, 2001 (TW) ..... 90107264 A

(51) Int. Cl.[7] ..... H01J 17/44; H01J 61/54

(52) U.S. Cl. ..... 313/594; 313/234; 313/607; 313/634

(58) Field of Search ..... 313/634, 607, 313/594, 234, 495, 485, 491, 492, 631, 306, 493, 292, 484

(56) References Cited

U.S. PATENT DOCUMENTS

| | | | | | |
|---|---|---|---|---|---|
| 4,767,965 | A | * | 8/1988 | Yamano et al. | 313/491 |
| 5,329,203 | A | * | 7/1994 | Jeong | 313/491 |
| 5,461,279 | A | * | 10/1995 | Hasegawa | 313/493 |
| 6,040,973 | A | * | 3/2000 | Okamoto et al. | 361/235 |
| 6,075,320 | A | * | 6/2000 | Winsor | 313/634 |

FOREIGN PATENT DOCUMENTS

| | | | | |
|---|---|---|---|---|
| JP | 05325905 | A | * 12/1993 | H01J/61/54 |

* cited by examiner

*Primary Examiner*—Mariceli Santiago
(74) *Attorney, Agent, or Firm*—Haverstock & Owens LLP

(57) ABSTRACT

The cold cathode fluorescent flat lamp includes an enclosure chamber sealed by two reciprocally parallel plates of glass and containing a gas therein, an anode and a cathode disposed in the enclosure chamber, wherein the cathode is parallel to the anode, an auxiliary anode disposed between the anode and the cathode and being parallel to the cathode, wherein the auxiliary anode is attached to a surface of either plates of glass, and a printed circuit board for providing a voltage for the anode and the cathode.

12 Claims, 4 Drawing Sheets

COLD CATHODE FLUORESCENT FLAT LAMP

FIELD OF THE INVENTION

The present invention is related to a cold cathode fluorescent flat lamp, and more particularly to a cold cathode fluorescent flat lamp for solving the light-vibration problem and improving the illumination brightness uniformity thereof.

BACKGROUND OF THE INVENTION

A cold cathode fluorescent flap lamp is a light-illuminating device applied in all kinds of fields in our life. Please refer to FIG. 1 which is a schematic diagram illustrating a cross-sectional view of a conventional cold cathode fluorescent flat lamp. An enclosure chamber of the cold cathode fluorescent flat lamp is sealed by two reciprocally parallel plates of glass 13. The enclosure chamber is filled with a gas 14 selected from a group consisting of inert gas, mercury gas, and a mixing gas thereof. Preferably, the inert gas can be a helium gas, a neon gas, an argon gas, a krypton gas, a xenon gas, or a mixing gas thereof. By being provided with a voltage for an anode 11 and a cathode 12, the electrons emitting from the cathode 12 collide with the gas molecules contained in the enclosure chamber in such a way that a plasma is produced. Because of the energy difference between the exciting states and the ground states of the gas molecules, an ultraviolet light is produced when the gas molecules release the energy from the exciting states thereof to the ground states thereof. As a result, a visible light is produced when a fluorescent substance coated on the surfaces of the plates of glass 13 is illuminated with the ultraviolet light.

However, the surfaces of the electrodes, especially the cathode 12, produced according to the prior arts are very rough and plural protruding points 121 are formed thereron. Certainly, the electrons are easy to be emitted from the protruding points 121 and therefore the ions of the plasma with positive charge easily aggregate around the cathode 12. Extraordinarily, in the end, because of aggregation of the ions with positive charge around the cathode 12, the electrons are not easy to be emitted from the protruding points 121. Consequently, such a phenomenon induces a charging/discharging effect of the cathode 12. The induced charging/discharging effect will result in the light-vibration problem and lower the illumination brightness uniformity of the cold cathode fluorescent flat lamp.

Even if a further step of electropolish can be included into the method of processing the cathode to smooth the surface thereof, the electrons are still easy to be emitted from the two opposite ends 122 of the cathode 12. On the other hand, adding a step of electropolish not only increases the manufacturing cost of the cathode but also results in the problem of environmental pollution.

Accordingly, it is attempted by the present applicant to overcome the above-described problems encountered in the prior arts.

SUMMARY OF THE INVENTION

An object of the present invention is to provide a cold cathode fluorescent flat lamp for solving the light-vibration problem.

Another object of the present invention is to provide a cold cathode fluorescent flat lamp for improving the illumination brightness uniformity.

A further object of the present invention is to provide a cold cathode fluorescent flat lamp of low manufacturing cost.

According to an aspect of the present invention, a cold cathode fluorescent flat lamp is disclosed. The cold cathode fluorescent flat lamp includes an enclosure chamber sealed by two reciprocally parallel plates of glass and containing a gas therein, an anode and a cathode disposed in the enclosure chamber, wherein the cathode is parallel to the anode, an auxiliary anode disposed between the anode and the cathode and being parallel to the cathode, wherein the auxiliary anode is attached to a surface of either plates of glass, and a printed circuit board for providing a voltage for the anode and the cathode.

Preferably, the anode and the cathode are made of nickel.

Preferably, the gas is selected from a group consisting of inert gas, mercury gas, and a mixing gas thereof. Preferably, the inert gas is selected from a group consisting of helium gas, neon gas, argon gas, krypton gas, xenon gas, and a mixing gas thereof.

Preferably, a pressure of gas contained in the enclosure chamber is ranged from 3 to 200 torr.

Preferably, the auxiliary anode is made of a material selected from a group consisting of copper, nickel, and aluminum.

Preferably, the cold cathode fluorescent flat lamp further includes a fluorescent substance coated on each surface of the plates of glass.

In an alternative, the cold cathode fluorescent flat lamp includes an enclosure chamber sealed by two reciprocally parallel plates of glass and containing a gas therein, an anode disposed in the enclosure chamber, a cathode disposed in the enclosure chamber and comprising a main body and two inclined fringes on each end thereof, wherein the main body of the cathode is parallel to the anode, and a printed circuit board for providing a voltage for the anode and the cathode.

Preferably, the anode and the cathode are made of nickel.

Preferably, the gas is selected from a group consisting of inert gas, mercury gas, and a mixing gas thereof. Preferably, the inert gas is selected from a group consisting of helium gas, neon gas, argon gas, krypton gas, xenon gas, and a mixing gas thereof.

Preferably, a pressure of gas contained in the enclosure chamber is ranged from 3 to 200 torr.

Preferably, the cold cathode fluorescent flat lamp further includes a fluorescent substance coated on each surface of the plates of glass.

Preferably, an inclined angle between the inclined fringe and the main body is ranged from 0° to 90°.

According to another aspect of the present invention, a structure of a field emission electrode adapted to be used for a cold cathode fluorescent flat lamp is disclosed. The structure includes an anode, a cathode being parallel to the anode, and an auxiliary anode disposed between the anode and the cathode and being parallel to the cathode, wherein the auxiliary anode is attached to a surface of a chamber of the cold cathode fluorescent flat lamp.

Preferably, the anode and the cathode are made of nickel.

Preferably, the auxiliary anode is made of a material selected from a group consisting of copper, nickel, and aluminum.

BRIEF DESCRIPTION OF THE DRAWING

The present invention may best be understood through the following description with reference to the accompanying drawings, in which.

DETAILED DESCRIPTION OF THE PREFERRED EMBODIMENTS

Figure 1:
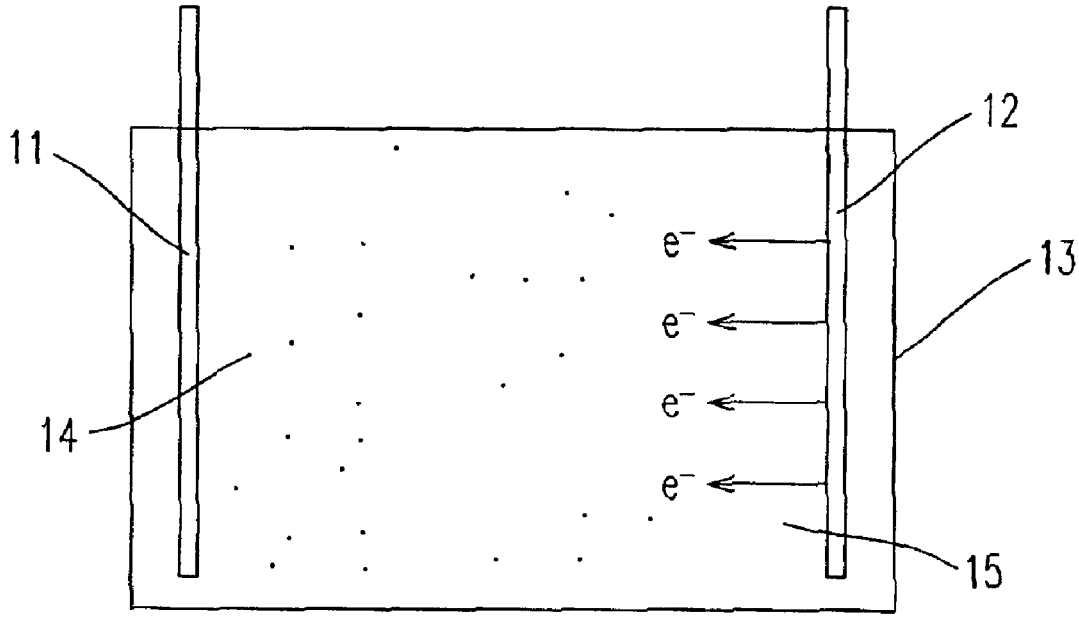
Fig. 1(PRIOR ART)
FIG. 1 is a schematic diagram illustrating a cross-sectional view of a conventional cold cathode fluorescent flat lamp.
Figure 2:
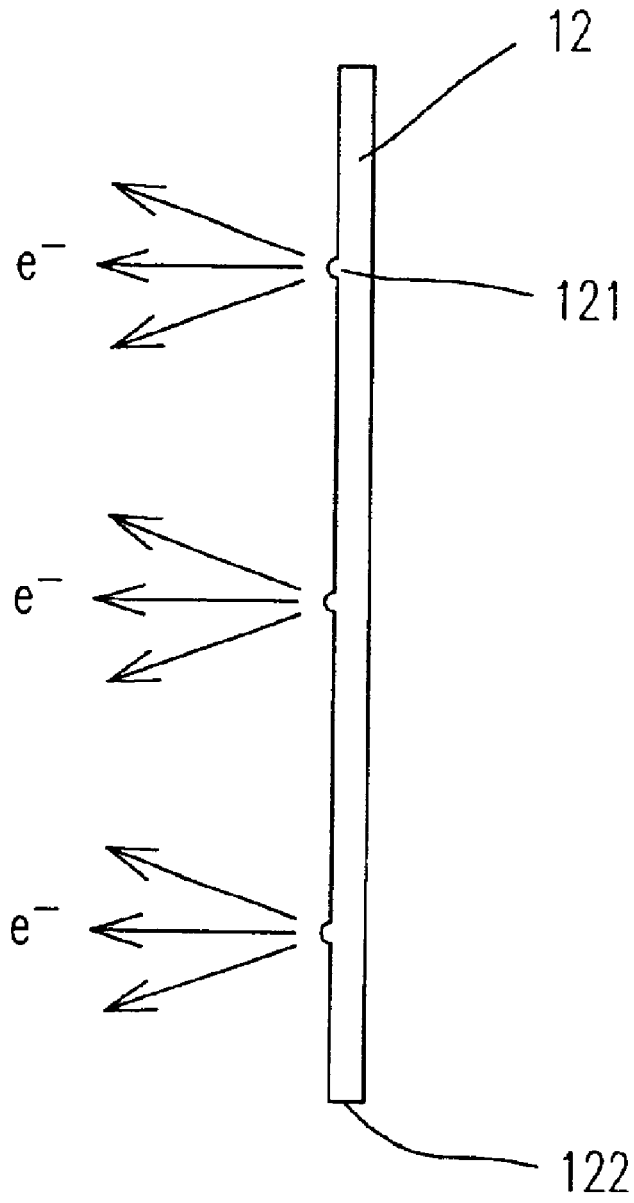
Fig. 2(PRIOR ART)
FIG. 2 is a schematic diagram schematic diagram showing how the electrons emitting from a cathode of a conventional cold cathode fluorescent flat lamp.
Figure 3:
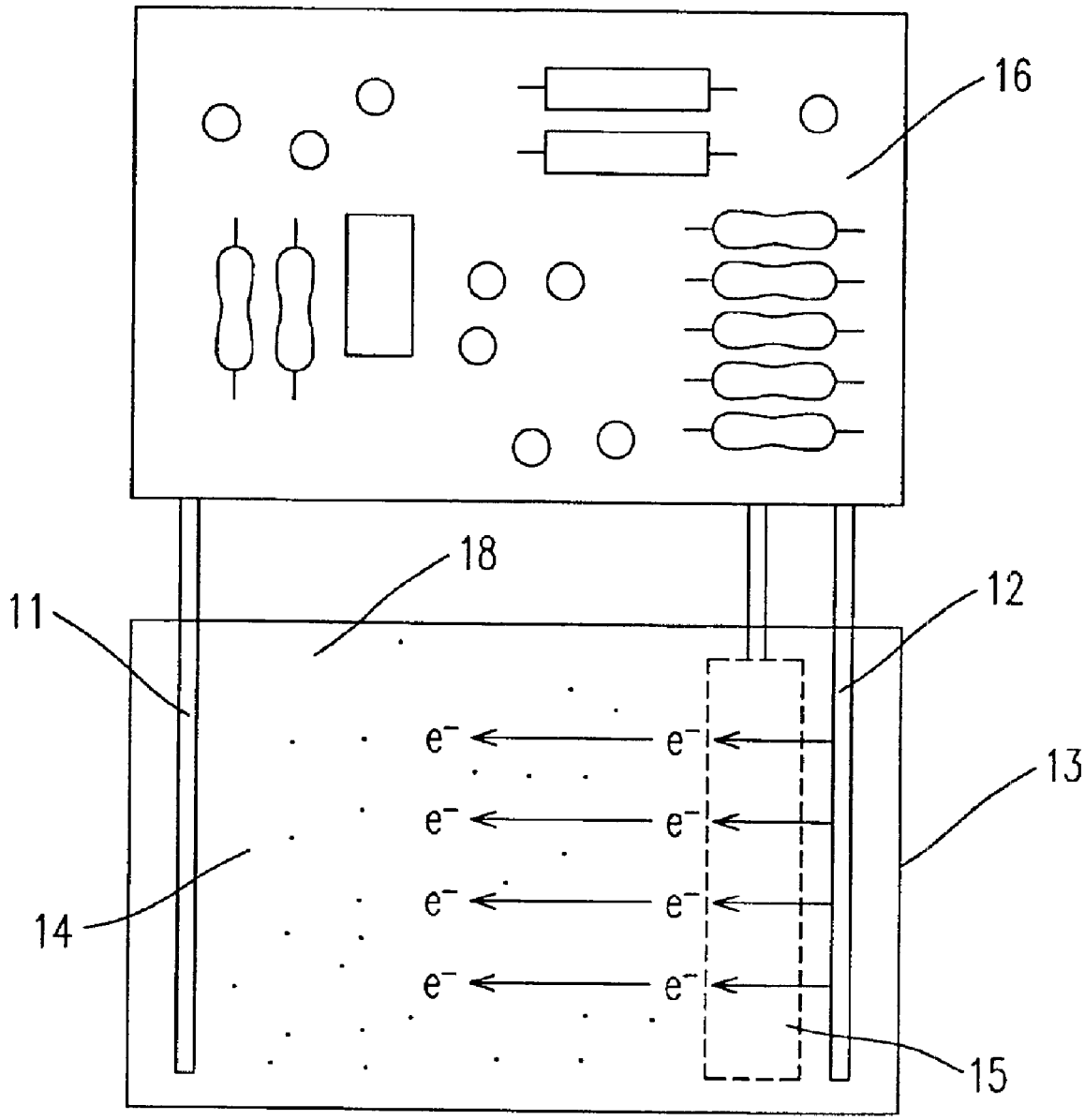
FIG. 3 is a schematic diagram illustrating a cross-sectional view of a cold cathode fluorescent flat lamp according to a first preferred embodiment of the present invention.

Please refer to FIG. 3 which is a schematic diagram illustrating a cross-sectional view of a cold cathode fluorescent flat lamp according to a first preferred embodiment of the present invention. The cold cathode fluorescent flat lamp includes an enclosure chamber 18 sealed by two reciprocally parallel plates of glass 13, an anode 11 and a cathode 12 disposed in the enclosure chamber 18, an auxiliary anode 15 disposed between the anode 11 and the cathode 12, and a printed circuit board 16 for providing a voltage for the anode 11 and the cathode 12. Preferably, a first distance between the auxiliary anode 15 and the cathode 12 is smaller than a second distance between the auxiliary anode 15 and the anode 11 in order to assist the emitting of electrons from the cathode 12 and also to inhibit the bombardment of cation on the cathode 12. The anode 11 and the cathode 12 are parallel to each other. The auxiliary anode 15 is attached to a surface of either plates of glass 13 and parallel to the cathode 12. A gas 14 is contained in the enclosure chamber. The gas 14 is selected from a group consisting of inert gas, mercury gas, and a mixing gas thereof. Preferably, the inert gas can be a helium gas, a neon gas, an argon gas, a krypton gas, a xenon gas, or a mixing gas thereof. A pressure of the gas 14 contained in the enclosure chamber 18 is ranged from 3 to 200 torr. Preferably, the anode 11 and the cathode 12 are made of nickel, and the auxiliary is made of a material selected from a group consisting of copper, nickel, and aluminum.

By being provided with a voltage for the anode 11 and the cathode 12, because of the voltage difference of the auxiliary anode 15 and the cathode 12, the electrons emitting from the cathode 12 are attracted by the auxiliary anode 15 first. The emitting electrons are accelerated through the formed electrical field between the anode 11 and the cathode 12. After colliding with the gas molecules contained in the enclosure chamber 18, a plasma is produced. Because of the energy difference between the exciting states and the ground states of the gas molecules, an ultraviolet light is produced when the gas molecules release the energy from the exciting states thereof to the ground states thereof. As a result, a visible light is produced when a fluorescent substance coated on the surfaces of the plates of glass 13 is illuminated with the ultraviolet light.

Alternatively, the printed circuit board 16 can be disposed on the backside of either plates of glass, and therefore a pattern of the auxiliary anode 15 can be directly formed thereon. On the ground of such an auxiliary anode 15, the probability for the ions of the plasma with positive charge to collide with the cathode can be lowered. Thus, the temperature measured on the surfaces of the plates of the glass can be lowered in the end.

Figure 4:
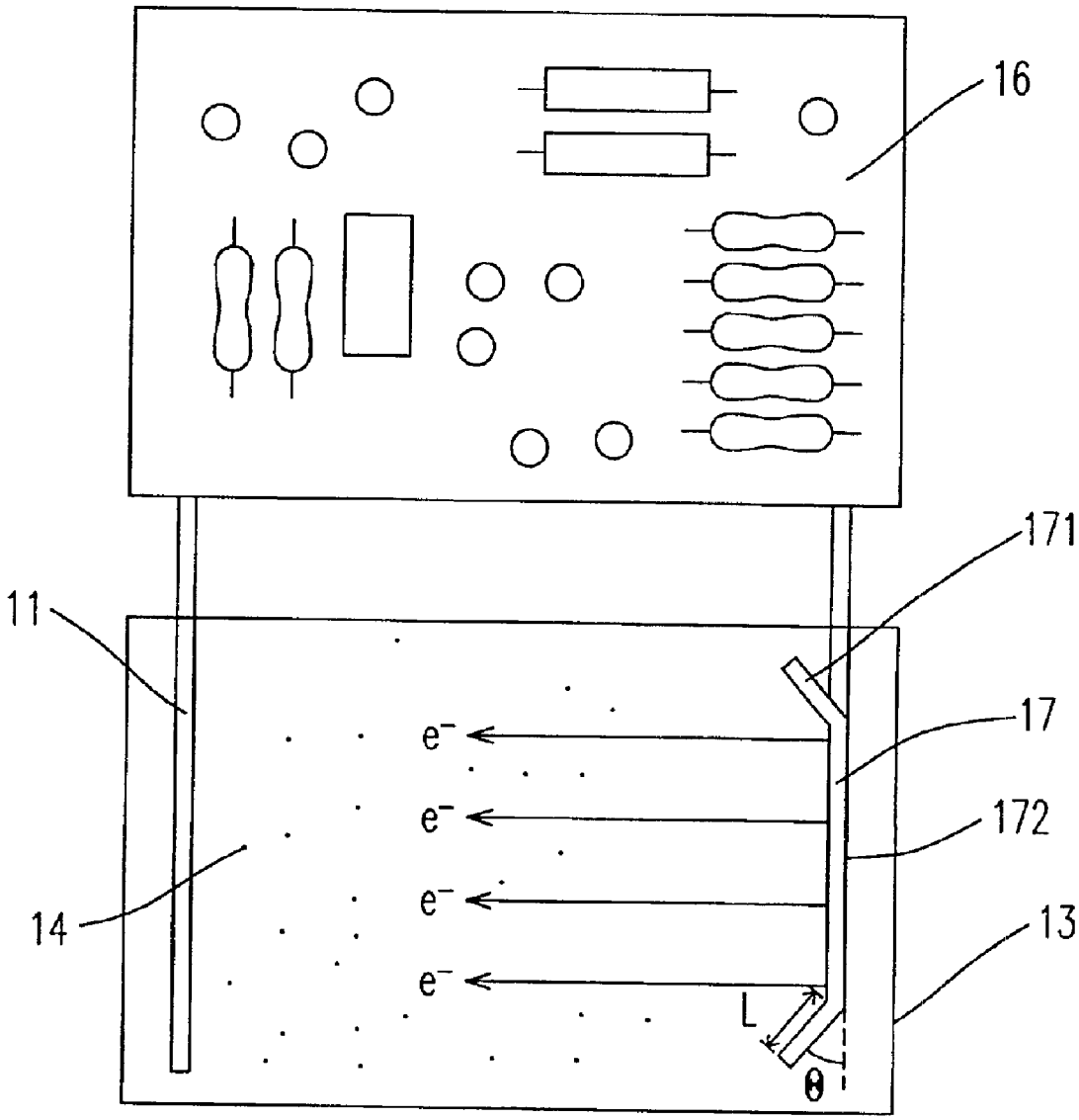
FIG. 4 is a schematic diagram illustrating a cross-sectional view of a cold cathode fluorescent flat lamp according to a second preferred embodiment of the present invention.

Please refer to FIG. 4 which is a schematic diagram illustrating a cross-sectional view of a cold cathode fluorescent flat lamp according to a second preferred embodiment of the present invention. Unlike FIG. 3, without including an auxiliary anode 15 (as shown in FIG. 3), the electrodes include an anode 11 and a cathode 17 only. The cathode 17 includes a main body 172 and two inclined fringes 171 on each end therof. The main body 172 of the cathode 17 is parallel to the anode 11. By forming two inclined fringes on each end of the cathode, the light-vibration problem can be solved and the illumination brightness uniformity can be improved as well. Preferably, the length (L) of each inclined fringe 171 is shorter than half-length of the cathode 17. Preferably, the inclined angle (θ) between each inclined fringe 172 and the main body 171 is ranged from 0° to 90°.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A cold cathode fluorescent flat lamp, comprising:

an enclosure chamber sealed by two reciprocally parallel plates of glass and containing a gas therein;

an anode and a cathode disposed in said enclosure chamber, wherein said cathode is parallel to said anode;

an auxiliary anode disposed between said anode and said cathode and being parallel to said cathode, wherein said auxiliary anode is attached to an outer surface of either said plates of glass, and a first distance between said auxiliary anode and said cathode is smaller than a second distance between said auxiliary anode and said anode; and a printed circuit board having said anode, said cathode and said auxiliary anode thereon.

2. The cold cathode fluorescent flat lamp according to claim 1 wherein said anode is made of nickel.

3. The cold cathode fluorescent flat lamp according to claim 1 wherein said cathode is made of nickel.

4. The cold cathode fluorescent flat lamp according to claim 1 wherein said gas is selected from a group consisting of inert gas, mercury gas, and a mixing gas thereof.

5. The cold cathode fluorescent flat lamp according to claim 4 wherein said inert gas is selected from a group consisting of helium gas, neon gas, argon gas, krypton gas, xenon gas, and a mixing gas thereof.

6. The cold cathode fluorescent flat lamp according to claim 5 wherein a pressure of gas contained in said enclosure chamber is ranged from 3 to 200 torr.

7. The cold cathode fluorescent flat lamp according to claim 1 wherein said auxiliary anode is made of a material selected from a group consisting of copper, nickel, and aluminum.

8. The cold cathode fluorescent flat lamp according to claim 1, further comprising a fluorescent substance coated on each surface of said plates of glass.

9. A structure of a field emission electrode adapted to be used for a cold cathode fluorescent flat lamp, comprising:

an anode;

a cathode being parallel to said anode; and an auxiliary anode disposed between said anode and said cathode and being parallel to said cathode, wherein said auxiliary anode is attached to an outer surface of a chamber of said cold cathode fluorescent flat lamp, wherein the anode, the cathode and the auxiliary anode are on a printed circuit board and a first distance between said auxiliary anode and said cathode is smaller than a second distance between said auxiliary anode and said anode.

10. The structure according to claim 9 wherein said anode is made of nickel.

11. The structure according to claim 9 wherein said cathode is made of nickel.

12. The structure according to claim 9 wherein said auxiliary anode is made of a material selected from a group consisting of copper, nickel, and aluminum.

* * * * *

UNITED STATES PATENT AND TRADEMARK OFFICE

CERTIFICATE OF CORRECTION

PATENT NO. : 6,861,804 B2
APPLICATION NO. : 09/923877
DATED : March 1, 2005
INVENTOR(S) : Wen-Tsang Liu et al.

It is certified that error appears in the above-identified patent and that said Letters Patent is hereby corrected as shown below:

Title page,
Item [73], delete "Optoelectronics, Inc." and insert -- Delta Optoelectronics, Inc. --.

Signed and Sealed this

Twentieth Day of June, 2006

JON W. DUDAS
*Director of the United States Patent and Trademark Office*